United States Patent [19]

Pitchford et al.

[11] Patent Number: 4,620,426

[45] Date of Patent: Nov. 4, 1986

[54] SPORTSMAN'S INSULATED BEVERAGE CONTAINER

[76] Inventors: Gary G. Pitchford; Steven C. Pitchford, both of 9215 S. Montezuma, Phoenix, Ariz. 85041

[21] Appl. No.: 778,627

[22] Filed: Sep. 23, 1985

[51] Int. Cl.[4] ..... F25D 3/08

[52] U.S. Cl. ..... 62/457; 62/272; 62/530

[58] Field of Search ..... 62/457, 372, 530

[56] References Cited

U.S. PATENT DOCUMENTS

| | | | |
|---|---|---|---|
| 3,406,532 | 10/1968 | Rownd et al. | 62/457 |
| 4,183,226 | 1/1980 | Moore | 62/457 |
| 4,266,407 | 5/1981 | Gibson | 62/457 X |
| 4,295,345 | 10/1981 | Atkinson | 62/457 X |
| 4,505,132 | 3/1985 | Howes et al. | 62/530 X |

*Primary Examiner*—Lloyd L. King

*Attorney, Agent, or Firm*—Harry M. Weiss & Associates

[57] ABSTRACT

An insulated beverage container having a sturdy outer casing housing therein a specially-shaped foam housing and a preferably flexible, yet durable end ring mounted thereabove said foam housing is disclosed. The internally located foam housing is shaped in a manner so as to be suitable for accommodating at least two conventionally shaped beverage can containers therein. At least two blue ice container means are located preferably above said beverage can containers. Moreover, the outer casing is suitable for removeably coupling a cover head means thereabove said outer casing and for accommodating therein said blue ice container means. Further, said outer casing is capable of having a sufficiently rigid, yet flexible, clip removably attached thereto. An inner bottle means may alternatively be accommodated therein said foam housing having said blue ice container means thereabove said inner bottle means.

16 Claims, 8 Drawing Figures

SPORTSMAN'S INSULATED BEVERAGE CONTAINER

BACKGROUND OF THE INVENTION

This invention relates generally to an insulated beverage container. More particularly, the invention relates to a beverage container suitable for accommodating an inner bottle, or in the alternative, capable of accommodating therein at least one beverage can container.

Conventionally, an insulating container, suitable for keeping a liquid medium therein at a desired temperature, makes use of a breakable vacuum-type thermal glass tube liner. When the conventional insulating container is used for its ordinary purpose of being constantly transported, the chances of said insulating container receiving various stresses at the exterior portion which are transferred to the interior portion are significantly increased. Due to said variegated stresses experienced by the insulating container, breakage frequently occurs at the vacuum-type thermal glass tube liner which can be extremely costly when frequent replacements must be done. Moreover, a conventional insulating container having a breakable vacuum-type thermal glass tube liner would have only a limited feasible size due to the increase in likelihood of breakage of said liner as the size of said liner is exposed.

Further, a conventional insulating container which does not utilize a breakable liner, yet only suitable for accommodating at least one beverage container therein, tends to require a plurality of cold solid medium, such as ice cubes. Here, however, not only does the conventional insulating container manifest a highly disorganized or messy accommodation of ice cubes, but tends to increase the likelihood of melting said ice cubes and thereby resulting in unwanted leaks. Thus, if used for rugged terrain or region, the conventional insulating container will be completely ineffective and clearly unsuitable for use by a sportsman. Accordingly, there is a dire need for an efficient, economical, simply constructed and easily assembled insulated beverage container suitable for incorporating therein thoroughly unbreakable parts and capable of sustaining various stresses at all directions. Moreover, the insulated beverage container should embody simply constructed combination of inexpensive and rapidly manufactured parts, yet efficient to retain a desired temperature of the liquid medium accommodated therein by further providing a relatively tight seal suitable for precluding any leaks therefrom. Further, the insulated beverage container must withstand numerous and continuous use in rugged terrain or region indigenous to the environment of a sportsman.

SUMMARY OF THE INVENTION

It is an object of the present invention to provide an insulated beverage container for accommodating an inner bottle for retaining a desired temperature of liquid medium accommodated therein.

It is still another object of the present invention to provide an insulated beverage container suitable for accommodating therein at least one beverage can container for retaining a desired temperature of liquid medium accommodated therein said beverage can container.

It is still another object of the present invention to provide an insulated beverage container which may be easily and rapidly assembled in a compact form having few parts which may be capable of effectively sealing liquid medium accommodated therein.

It is yet another object of the present invention to provide an insulated beverage container which may be able to accommodate therein a plurality of completely solid cooling medium in a neatly operable fashion to preclude any intrusion in the outflow of the liquid medium accommodated therein said inner bottle.

It is a further object of the present invention to provide an insulated beverage container which may be able to accommodate therein a plurality of completely solid cooling medium abutting said beverage can container in highly space efficient manner for retaining a desired temperature of the liquid medium accommodated therein said beverage can containers.

It is yet a further object of the present invention to provide an insulated beverage container utilizing therefrom parts which will be durable in construction, long lasting, economical and efficient when in use.

In accordance with one embodiment of this invention, there is a sturdy outer casing housing therein a specially-shaped foam and a preferably flexible, yet durable end ring mounted thereabove said foam. The internally located foam is shaped in a manner so as to be suitable for accommodating at least two conventionally shaped beverage can containers therein. At least two blue ice container means are located preferably above said beverage can containers. Moreover, the outer casing is suitable for removably coupling a cover head means thereabove said outer casing and for accommodating therein said blue ice container means. Further, said outer casing is capable of having a sufficiently rigid, yet flexible, clip removably attached thereto.

The foregoing and other objects, features and advantages of this invention will be apparent from the following, more particular description of the preferred embodiments of this invention, as illustrated in the accompanying drawings.

FIG. *6a* is a top elevational view while FIG. *6b* is a side elevational view of a blue ice container means of the insulated beverage container of the present invention.

Figures 1, 7:
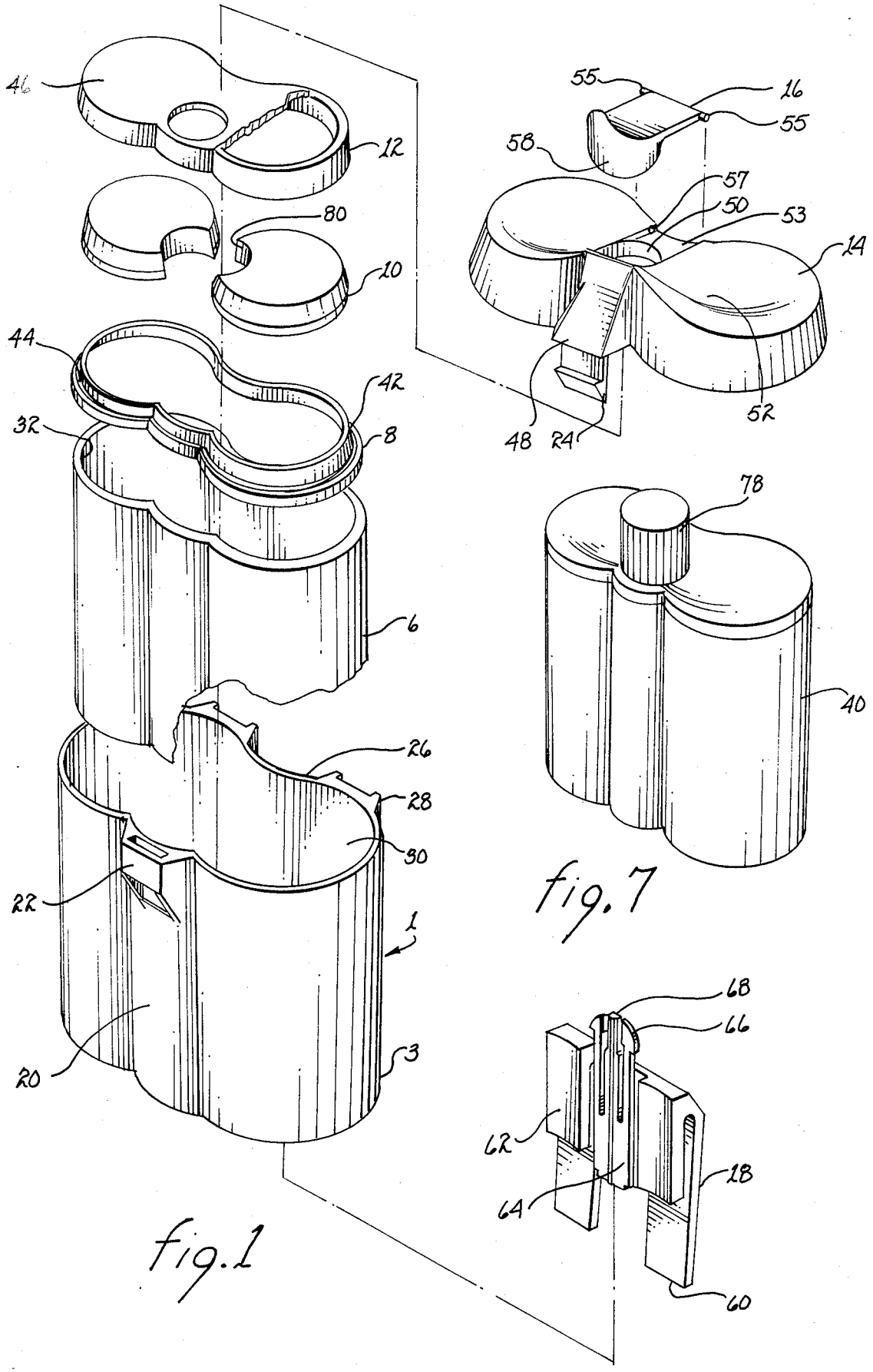
FIG. 1 is an exploded perspective view of the insulated beverage container of the present invention showing the manner in which the outer casing accommodates other various functional parts thereto.

FIG. 7 is a perspective view of an inner bottle having an integral spout generally vertically protruding therefrom of the insulated beverage container of the present invention.

DESCRIPTION OF THE PREFERRED EMBODIMENT

FIG. 1 is an exploded perspective view of an insulated beverage container, generally designated by reference number 1, illustrating the manner in which a plurality of integral parts are assembled thereto including an outer casing 3, a specially configured foam 6, an end ring 8 suitable for resting on said foam 6, at least one blue ice container means 10, an upper support member 12, a cover member means 14 suitable for adjustably accommodating an opening lid means 16 and a sturdy, yet flexible, clip means 18 suitable for removably mounting the back portion of the outer casing 3.

As further shown in FIG. 1, the outer casing 3 has a front portion 20 having an integral female latch member means 22 for accommodating therein a protruding member 24 integral to the cover member means 14. Moreover, the outer casing 3 has a back portion 26 having at least a pair of first integral hinge member means 28 suitable for swingably accommodating the cover member means 14. A cavity 30 preferably shaped like at least a pair of adjoining circles accommodates therein a similarly formed foam 6.

The foam 6 is preferably made of closed-cell Ensolite (manufactured by Uniroyal, Inc. of Mishawaka, Ind., Trocellen plastic (manufactured by Dynamit Nobel of America, Inc. of South Holland, Ill., or similarly tough, resilient and durable foam. The internal surface 32 of the foam 6 preferably has a plurality of ribbing-like members (not shown) protruding therefrom in order to increase the stress absorption characteristic, as well as increasing the insulating characteristic of said foam 6 when accommodating therein at least one beverage container 35, 38 (see FIG. 4, infra.) or an inner bottle 40 (see FIG. 7, infra.) which will later be discussed.

The end ring 8 has a configuration suitable for properly resting onto the foam 6; i.e., a similarly shaped like at least a pair of adjoining circles. Moreover, the upper portion of the end ring 8 has a slanted member 42 and a ledge type member 44 suitable, in combination, of accommodating the upper support member 12 to be rested thereto. The end ring 8 is preferably made of an elastomer injection plastic or any other flexible, yet durable, material. Similarly, the upper support member 12 is preferably made of an elastomer injection plastic or any other flexible, yet durable, material. Here, the upper support member 12 is preferably configured in a shape like at least a pair of adjoining circles to be suitable for resting onto the ledge type member 4 of the end ring 8. The upper support member 12 has a roof member 46 for integrally joining to the inner top surface of the cover member means 14.

The cover member means 14 has, on the front portion 48 integral thereto, as clearly illustrated in FIG. 1, a protruding member 24 extending therefrom. Further, the cover member means 14 has an aperture 50 passing therethrough the upper portion 52, as well as a central section 53 suitable for accommodating therein an opening lid means 16 having protruding members 55, each being operably inserted into an aperture 57 to provide a hinged-like connection thereto. The opening lid means 16 has a partly spherical member 58 to permit accommodation into said aperture 50. The opening lid means 16 and the cover member means 14, as well as the outer casing 3 and the clip means 18, are all preferably made out of polyester polycarbonate blend material or any other type of tough, durable and long lasting material.

Figure 5:
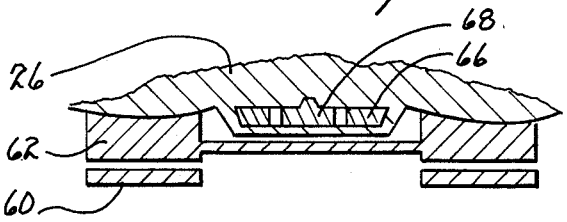
FIG. 5 is a cross-sectional view of the insulated beverage container of the present invention taken along line 5—5 of FIG. 2 illustrating an embodiment of the sufficiently rigid, yet flexible, clip means with an associated sectional back portion of said insulated beverage container.

The clip means 18 has at least a pair of flexible, yet sturdy long leg members 60 adjacent and partially integral to at least a pair of more rigid short leg members 62. A central elongated member 64 having at least a pair vertically protruding member 66 suitable for being flexed inwardly toward a centrally located vertically protruding member 68 to allow insertion into mounting onto and removal from the back portion 26 of the outer casing 3, as better illustrated in FIG. 2 (see also FIG. 5, infra.).

Figure 2:
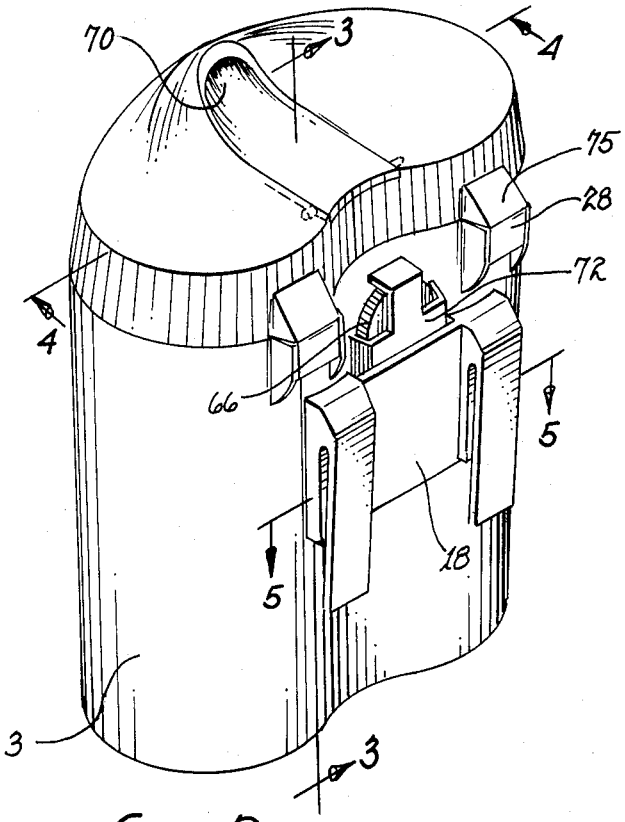
FIG. 2 is a perspective view of the insulated beverage container of the present invention showing the manner in which a sufficiently rigid, yet flexible, clip means is removably attached to the back portion of said insulated beverage container.

In FIG. 2, the opening lid means 16 has on the upper portion of the partly spherical member 58, an indented member 70 suitable for accommodating therein a tip of a finger to allow lifting of said opening lid means 16 and exposing thereby the aperture 50. As further shown in FIG. 2, a three-piece member 72 is integrally attached to the back portion 26 of the outer casing 3 in order to accommodate and mount therein the vertically protruding members 66 and the centrally located vertically protruding member 68 of the clip means 18. Further, the first hinge member means 28 of the cover member means 14 is accommodated by second hinge member means 75 integral to the back portion 26 of the outer casing 3.

Figure 3:
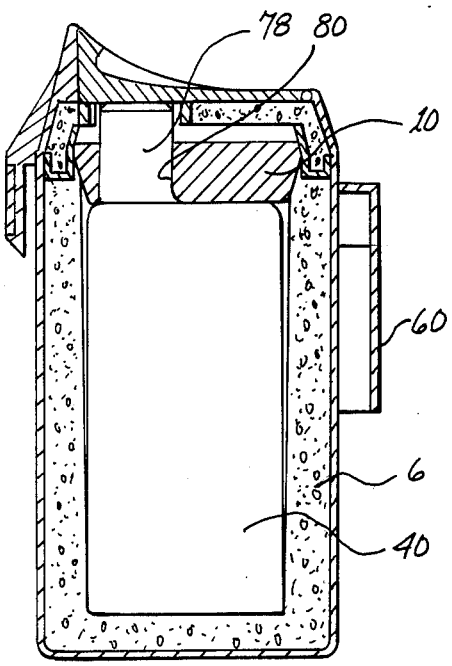
FIG. 3 is a cross-sectional view of the insulated beverage container of the present invention taken along line 3—3 of FIG. 2 showing the manner in which an inner bottle is accommodated therein.

In FIG. 3, an inner bottle 40 (see FIG. 7, infra.) having a spout means 78 integral thereto is accommodated therebetween the foam 6, preferably therebetween the plurality of ribbing like members, as previously discussed. The inner bottle, as well as the spout means 78, is preferably made of polyethlene teraphentalate material or a similar polyester blended tough, sturdy, lightweight and longlasting material. As further shown in FIG. 3, the spout means 78 is configured so as to be accommodated therebetween at least two partially circular enclosures 80 of the blue ice container means 10 (see FIG. 1).

Figure 4:
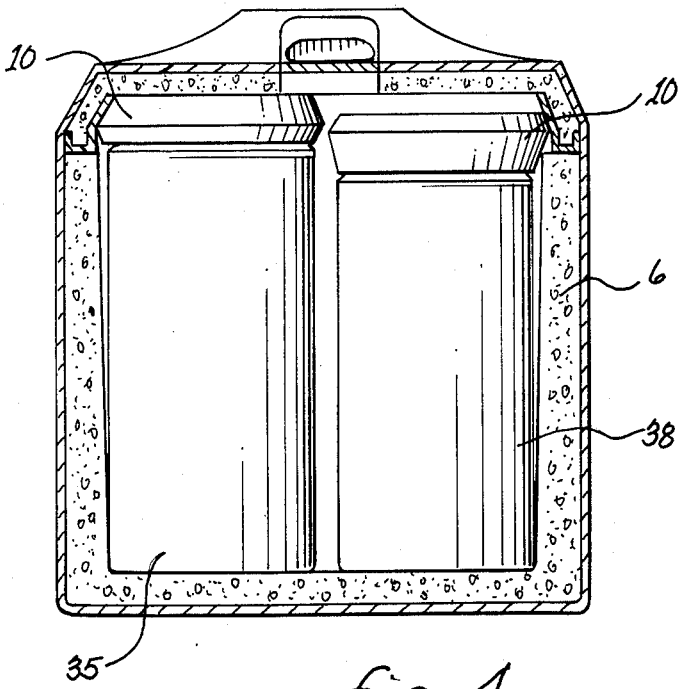
FIG. 4 is a cross-sectional view of the insulated beverage container of the present invention taken along line 4—4 of FIG. 2 showing the manner in which at least one beverage can container may be accommodated therein.
Figure 6A:
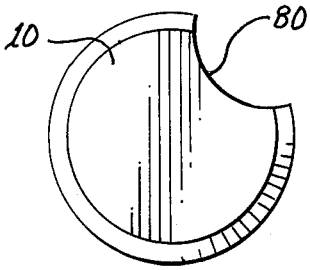
Figure 6B:
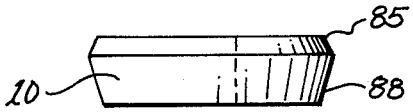

In FIG. 4, the foam 6 is further suitable for accommodating therein at least one beverage container 35, 38 having thereabove the blue ice container means 10. As illustrated in FIG. 6*a*, the blue ice container means 10 has a generally circular configuration with a partially circular enclosure 80 thereto. As better illustrated in FIG. 6*b*, the blue ice container means 10 has slanted upper 85 and lower 88 portions to appropriately fit therebetween the foam 6 and the end ring 8 (see FIGS. 1 and 3, supra.). The blue ice container means 10 is preferably made out of a high density polyethlene material or a similar rigid, long lasting and durable material having good conductive properties for cooling.

While the invention has been particularly shown and described in reference to preferred embodiments thereof, it will be understood by those skilled in the art that changes in form and details may be made without departing from the spirit and scope of the invention.

We claim:

1. An insulated beverage container, comprising;

an outer casing for providing a housing for said insulated beverage container;

a foam housing means for providing insulation for said insulated beverage container abutting the inner surface of said outer casing means;

an end ring means suitable for seating on the top portion of said foam housing means;

an upper support member means for resting onto the upper portion of said end ring means;

a cover member means for integrally accommodating said upper support member means into the upper and inner surface of said cover member means;

a clip means for removably attaching onto the back portion of said outer casing means having at least two upwardly protruding members for being adjustably accommodated therein a member means integral to the back portion of said outer casing;

at least one blue ice container means for cooling liquid medium accommodated therein said insulated beverage container;

a female latch member means integral to the front portion of said outer casing means; and a protruding member means integral to the front portion of said cover member means for being accommodated therein said female latch member means.

2. The insulated beverage container as in claim 1, further comprising:

an opening lid means for closing an aperture passing therethrough said cover member means;

a first hinge member means for integrally joining to the back portion of said outer casing means;

a second hinge member means integral to the back portion of said cover member means for rotatably joining to said first hinge member means;

protruding member means extending from said opening lid means suitable for being accommodated therein apertures on said cover member means for allowing rotatable joining of said opening lid means onto said cover member means.

3. The insulated beverage container as in claim 2 further comprising an inner bottle means suitable for being accommodated therein said foam housing means for housing a liquid medium, said inner bottle means is suitable for having said blue ice container means thereabove.

4. The insulated beverage container as in claim 2 wherein said foam housing means accommodates therein at least one beverage can container having said blue ice container means thereabove.

5. An insulated beverage container, comprising:

an outer casing having an internal surface cnfigured like at least two abutting circles;

a foam housing having inner and outer surfaces configured like at least two abutting circles, said foam housing suitable for being accommodated therein said outer casing; the inner surface of said foam housing has a plurality of ribbing-like member protruding therefrom;

an end ring having a ledge-type intermediate portion suitable for accommodating an upper support member integral to a cover member, said upper support member having a first aperture passing therethrough, said cover member has a second aperture passing therethrough abutting said first aperture of said upper support member;

a clip member suitable for removably attaching to the back portion of said outer casing having at least two upwardly protruding members for being adjustably accommodated therein a member means integral to the back portion of said outer casing, said clip member further has at least two downwardly extending leg members for removably attaching said insulated beverage container onto a user's camping equipment;

a female latch member integral to the front portion of said outer casing suitable for removably accommodating a flexible protruding member extending from the front portion of said cover member, said cover member has at least two hinge member means for swingably attaching to the upper back portion of said outer casing;

an opening lid swingably attached to said cover member for closing said second aperture passing therethrough said cover member; said opening lid has an indentation portion suitable for accommodating a user's finger therein to allow said opening lid to be detached from said second aperture of said cover member; and at least one blue ice container having circular configuration and partially circular enclosure abutting said first aperture of said upper support member and said second aperture of said cover member.

6. The insulated beverage container as in claim 5, further comprising an inner bottle configured to snugly abut said ribbing-like member of said foam housing, said inner bottle has a vertically protruding spout integral thereto suitable for being accommodated therebetween said partially circular enclosure of said blue ice container, said first aperture of said upper support member and said second aperture of said cover member.

7. The insulated beverage container as in claim 5 wherein said foam housing is suitable for accommodating therein at least one beverage can container, said beverage can container suitable for accommodating said blue ice container thereabove.

8. The insulated beverage container as in claim 5 wherein said cover member is made of a polyester polycarbonate blend material.

9. The insulated beverage container as in claim 5 wherein said foam housing is made of a material from the group consisting of closed-cell Ensolite and Trocellen plastic.

10. The insulated beverage container as in claim 5 wherein said end ring member is made of an elastomer injection plastic.

11. The insulated beverage container as in claim 5 wherein said blue ice container is made of a high density polyethlene material.

12. The insulated beverage container as in claim 5 wherein said upper support member is made of an elastomer injection plastic.

13. The insulated beverage container as in claim 5 wherein said cover member is made of polyester polycarbonate blend material.

14. The insulated beverage container as in claim 5 wherein said opening lid member is made of polyester polycarbonate blend material.

15. The insulated beverage container as in claim 5 wherein said clip member is made of polyester polycarbonate blend material.

16. The insulated beverage container as in claim 5 wherein said inner bottle having said integral spout member extending therefrom is made of polyethlene teraphentalate material.

* * * * *